US005884332A

United States Patent [19]

Snedeker

[11] Patent Number: 5,884,332

[45] Date of Patent: Mar. 23, 1999

[54] FIREFIGHTER GARMENT WITH LINER INSPECTION SYSTEM

[75] Inventor: Julie A. Snedeker, Northwood, N.H.

[73] Assignee: Globe Manufacturing Company, Pittsfield, N.H.

[21] Appl. No.: 102,660

[22] Filed: Jun. 23, 1998

[51] Int. Cl.[6] ..... A41D 13/00; A41D 1/02; A41D 1/06

[52] U.S. Cl. ..... 2/97; 2/81; 2/93; 2/227

[58] Field of Search ..... 2/2.16, 69, 81, 2/85, 87, 93, 97, 455, 456, 457, 458, 227, 69.5, 70, 84, 108

[56] References Cited

U.S. PATENT DOCUMENTS 4,817,210 4/1989 Aldridge et al. ..... 2/81
5,655,222 8/1997 Grilliot et al. ..... 2/81

*Primary Examiner*—Michael A. Neas
*Assistant Examiner*—Gary L. Welch
*Attorney, Agent, or Firm*—Watson Cole Grindle Watson, P.L.L.C.

[57] ABSTRACT

An outer protective shell of either a jacket or trousers has a torso portion and a pair of appendage portions connected to the torso portion. A liner is disposed within the shell and includes an outer moisture barrier and an inner thermal barrier. The moisture barrier is formed of a plurality of pieces joined together at seams. Sealing tapes on the inner surface of the moisture barrier are disposed over the seams to provide a waterproof seal at the seams. Lower edge portions of the moisture barrier and the thermal barrier are detachably connected to one another at spaced points so that the moisture barrier and the thermal barrier can be manually separated from one another to visually inspect said sealing tapes at all of said seams. In the jacket, the remaining edge portions of the barriers are permanently connected to one another. These remaining edge portions are detachably connected to the shell at spaced locations along the remaining edge portions. In the trousers, the upper edge portions of the barriers are permanently connected to one another and are detachably connected to the shell. In both the jacket and trousers, fasteners detachably connect the lower edge portion of the moisture barrier to the shell at spaced points along the lower edge portion of the moisture barrier.

10 Claims, 4 Drawing Sheets

FIG. 2
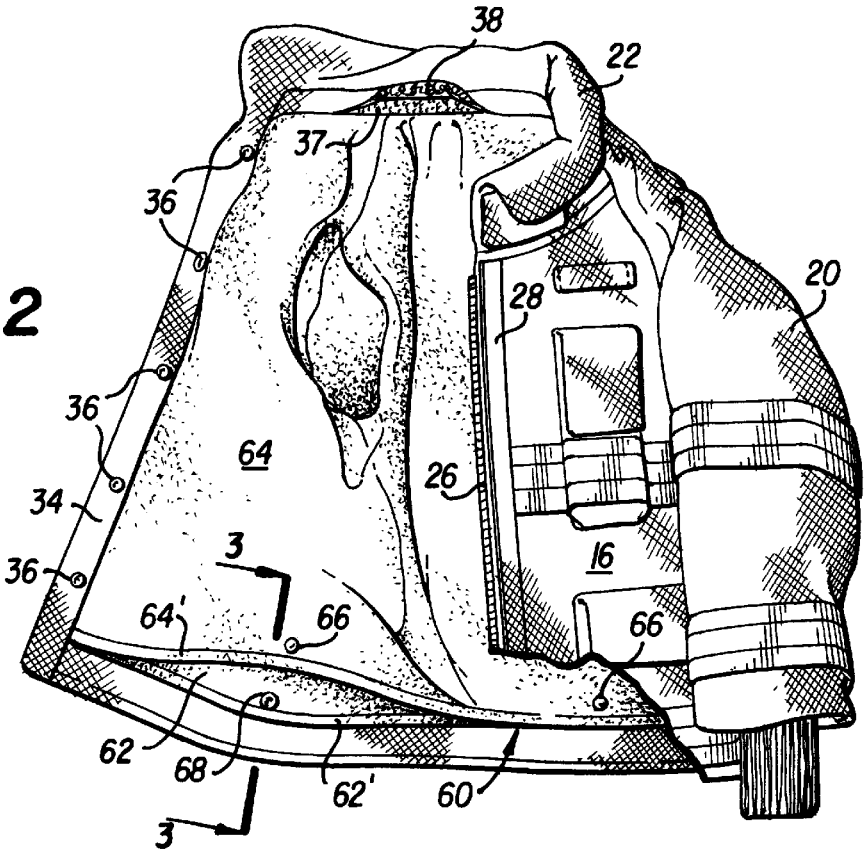
FIG. 5
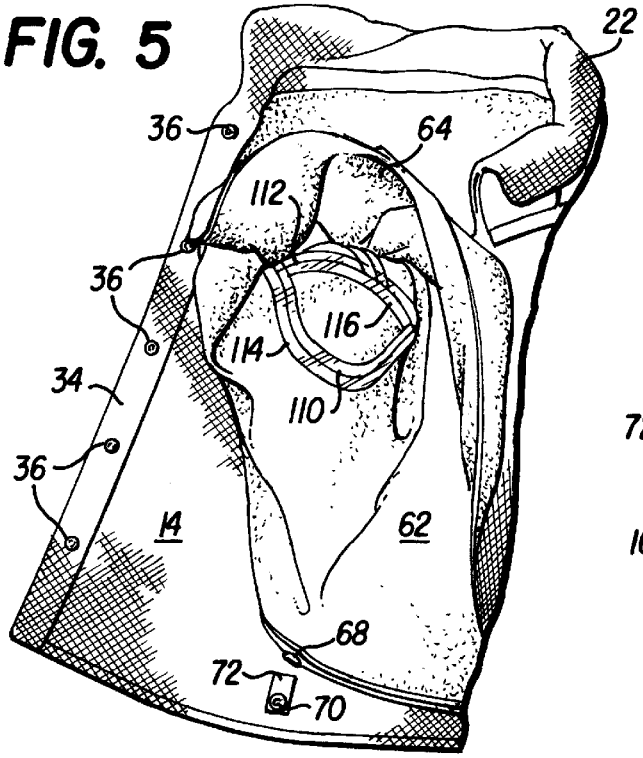
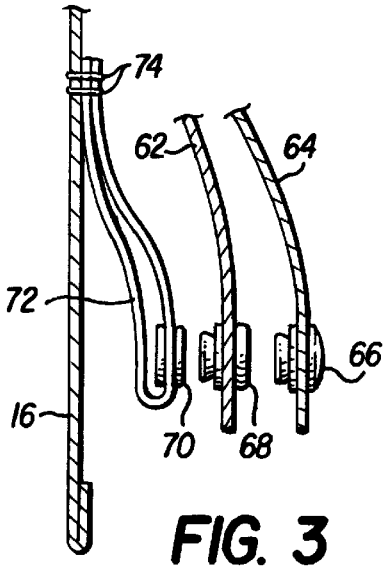
FIG. 3

FIREFIGHTER GARMENT WITH LINER INSPECTION SYSTEM

BACKGROUND OF THE INVENTION

The present invention relates to a firefighter garment such as a jacket or trousers, and more particularly to such a garment including a liner inspection system which enables a firefighter to inspect the liner at any time to ensure that the waterproof sealing means of the liner is intact.

Modern firefighter garments comprise an outer protective shell having a liner disposed therewithin. The liners include an outer moisture barrier and an inner thermal barrier. Ordinarily, these two barriers are manufactured as separate components which are stitched together completely around the edges thereof so that there is no means for gaining ready access to the space between the two barriers.

The moisture barrier and the thermal barrier of such liners are formed of a plurality of pieces of material cut according to certain patterns so that when the pieces are attached to one another the finished barriers have the proper configuration to fit within the associated garment. These pieces of each barrier are joined together along stitched seams. Early firefighter garments employing such moisture barriers did not employ any sealing means for ensuring a waterproof seal at such seams.

During firefighting operations, the firefighter garment is often subjected to a large amount of water which may impinge upon the garment with considerable force. Therefore, it is important that the garment be waterproof so that substantially no water will penetrate the moisture barrier and reach the thermal barrier. Water will penetrate through the seams of the moisture barriers of the liners of firefighter garments unless waterproof sealing means is provided at the seams.

Accordingly, it is now common practice to provide sealing means on the inwardly facing surface of the moisture barrier in the form of waterproof sealing tapes which overlap the seams and extend throughout the length thereof. This has proven to be an effective way of sealing the seams so that substantially no water penetrates into the space between the moisture barrier and the thermal barrier.

However, with the passage of time, such sealing tapes may be damaged or pull away from certain portions of the seams so that the seams are no longer sealed, thereby allowing water to pass through the seams. Therefore, it is desirable to provide a construction which permits a firefighter to readily visually inspect the sealing tapes to make sure that the tapes provide the desired waterproof seal at the seams of the moisture barrier.

SUMMARY OF THE INVENTION

In the present invention, the moisture barrier and the thermal barrier of the liner are permanently connected to one another at the upper edge portions thereof, such upper edge portions also being detachably connected to the outer shell. The lower edge portions of the moisture barrier and the thermal barrier are not permanently connected to one another as in the prior art, but are detachably connected to one another only at spaced points in such a manner that they can be easily detached to gain access to the space between the moisture barrier and the thermal barrier.

Furthermore, connecting means is provided for detachably connecting the moisture barrier to the shell at spaced points along the lower edge portion of the moisture barrier. This ensures that the moisture barrier is held in place within the shell, and since the moisture barrier and the thermal barrier are detachably connected to one another, neither of the barriers can ride up relative to one another or relative to the shell during firefighting operations, thereby holding the liner in place.

The connecting means includes a pair of spaced metal fasteners which are supported by cloth tabs connected to the inner surface of outer shell so that the fasteners are supported in spaced relation to the shell with a layer of cloth between the fasteners and the shell. This arrangement insulates the fasteners from the outer shell and prevents the metal fasteners from overheating during firefighting operations.

It is noted that about twenty-five years ago some jacket liners were made so that the bottoms of the moisture barrier and the thermal barrier were completely free of one another, or in other words, the bottoms of the barriers were not connected to one another in any manner. The purpose of such a construction was to facilitate drying of the liner after it had become wet. However, at that time, sealing tapes were not used for sealing seams of the moisture barrier, so there was no recognition of the problem encountered with the use of of sealing tapes such as employed in the present invention.

The present invention is different from the prior art liner construction discussed in the previous paragraph in that this prior art liner did not have sealing tapes at the seams of the moisture barrier. Furthermore, this prior art liner did not employ any means to detachably connect the moisture barrier and thermal barrier to one another along the lower edge portions thereof, nor did it employ means for detachably connecting the moisture barrier to the shell at spaced points along the lower edge portion of the moisture barrier, as in the present invention.

BRIEF DESCRIPTION OF THE DRAWINGS

FIG. 2 is an elevation of the firefighter jacket partly opened up to illustrate certain elements thereof;

FIG. 3 is an enlarged sectional view taken along line 3—3 of FIG. 2;

FIG. 5 is a view showing the jacket with a sleeve turned partially inside out;

DESCRIPTION OF THE PREFERRED EMBODIMENT

Figure 1:
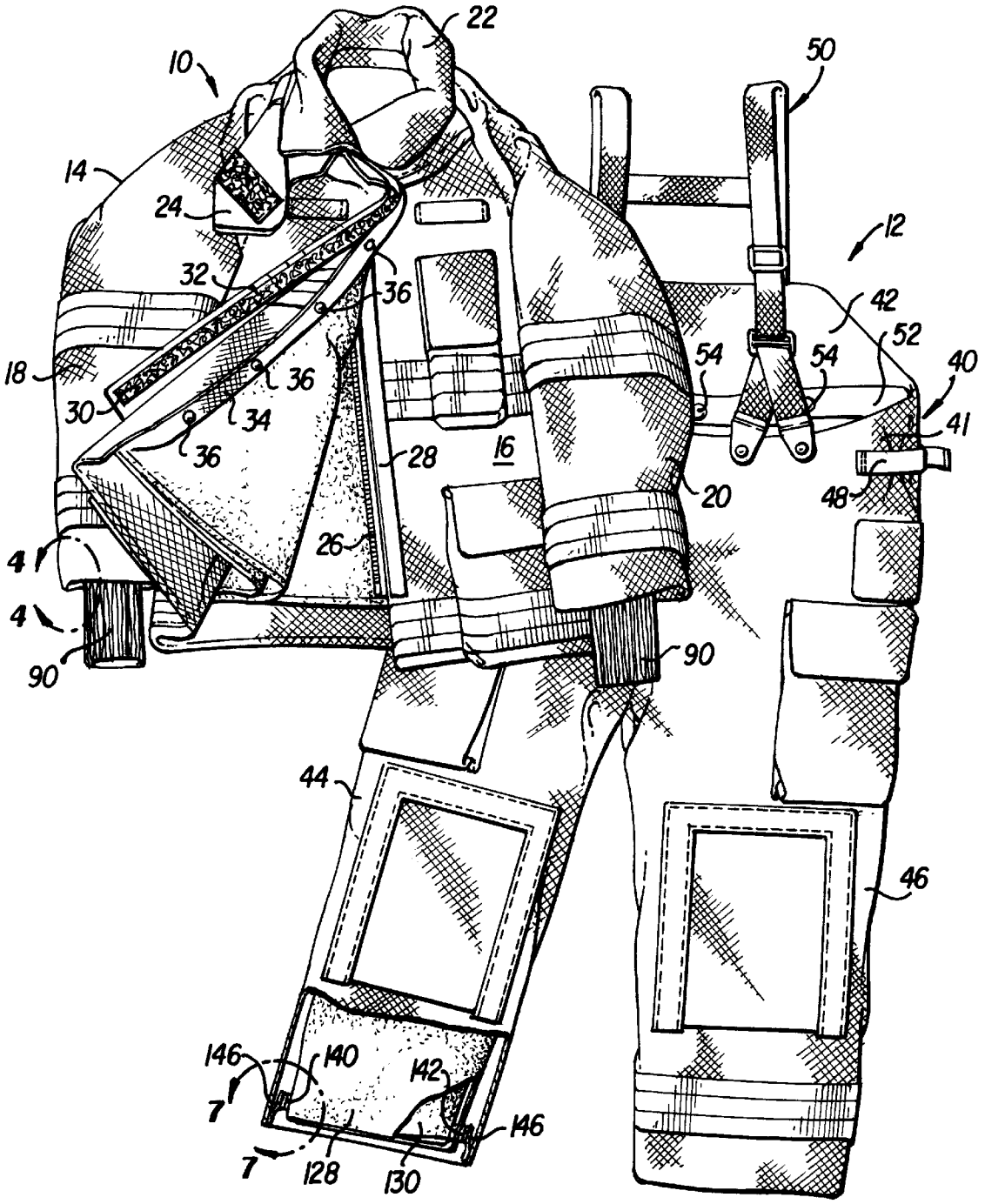
FIG. 1 is an elevation of a firefighter jacket and trousers with the lower right leg of the trousers partly broken away.

Referring now to the drawings wherein like reference characters designate corresponding parts throughout the several views, there is shown in FIG. 1 a firefighter turnout comprising a jacket 10 and trousers 12. The jacket has an outer protective shell 14 which includes a torso portion 16 and a pair of appendage portions in the form of sleeves 18 and 20 for receiving the arms of a firefighter. A collar 22 and a throat strap 24 are stitched to the shell in the usual manner.

One-half of a zipper 26 is secured to a first edge of the torso portion 16, and a strip of VELCRO 28 is secured to the torso portion adjacent zipper 26. Strip 28 is engageable with a strip of VELCRO 30 secured to storm flap 32. The other half of zipper 26 (not shown) is secured to torso portion 16 adjacent to the stitching securing the storm flap to the torso portion.

An inside facing strip 34 is secured to a second edge of the torso portion 16 and supports a plurality of conventional inwardly facing snap fasteners 36 which are adapted to cooperate with conventional outwardly facing snap fasteners (not shown) on the associated jacket liner hereinafter described for detachably connecting a side edge portion of the jacket liner to outer shell 14. It will be understood that a similar inside facing strip (not shown) is secured to the first edge of the torso portion for detachably connecting the opposite side edge portion of the jacket liner to the outer shell in a conventional manner. As seen in FIG. 2, the upper edge portion of the jacket liner is detachably connected to the shell by a strip of VELCRO 37 which is secured to the upper edge portion of the liner. Strip of VELCRO 37 is adapted to engage a strip of VELCRO 38 secured to the shell adjacent collar 22.

Trousers 12 have an outer shell 40 which includes a torso portion 41, a lumbar protection panel 42 and a pair of appendage portions in the form of leg portions 44 and 46. A take-up 48 is provided on both sides of the torso portion for adjusting the waist of the trousers; and a conventional pair of suspenders 50 is connected to the front of the torso portion and to panel 42. A conventional facing strip 52 is secured to shell 40 and supports a plurality of conventional inwardly facing snap fasteners 54 which are adapted to cooperate with fasteners on the upper edge portion of the associated trousers liner for detachably connecting the trousers liner to outer shell 40 as hereinafter described.

Referring to FIGS. 2 and 3, a jacket liner 60 includes an outer moisture barrier 62 and an inner thermal barrier 64 each of which is individually of conventional construction. Barriers 62 and 64 each have an upper edge portion, a lower edge portion and a pair of side edge portions. The upper edge portions and side edge portions of the moisture barrier and the thermal barrier are permanently connected to one another by stitching in a conventional manner. The bottom edge portions 62' and 64' of the moisture barrier and thermal barrier respectively are not stitched together as is common in the prior art, but are only detachably connected to one another at spaced points. As seen in FIG. 2, the two barriers are detachably connected to one another only at two widely spaced points by two snap fasteners 66 secured to thermal barrier 64, fasteners 66 being engageable with a pair of similar snap fasteners 68 secured to moisture barrier 62, only one of snap fastener 68 being visible in FIG. 2.

As seen in FIG. 3, snap fasteners 66 and 68 are shown as being disengaged from one another. Connecting means is provided for detachably connecting the moisture barrier to the shell in the form of another snap fastener 70 which engages snap fastener 68. Fastener 70 is supported by a tab 72 which is stitched at 74 to shell 16. The tab is formed of a strip of cloth material which is doubled on itself with the opposite ends thereof being stitched to the shell. With this construction, the tab supports the fastener in spaced relation to the shell and provides a layer of cloth material between the fastener and the shell to prevent overheating of the fastener during firefighting procedures.

There are two tabs 72 and associated fasteners 70 supported by shell 16 and being disposed adjacent the fasteners 68 on moisture barrier 62. This arrangement ensures that the moisture barrier and the thermal barrier do not ride up relative to one another and that the moisture barrier and the thermal barrier do not ride up relative to the shell when the firefighter using the jacket raises his arms.

Figure 4:
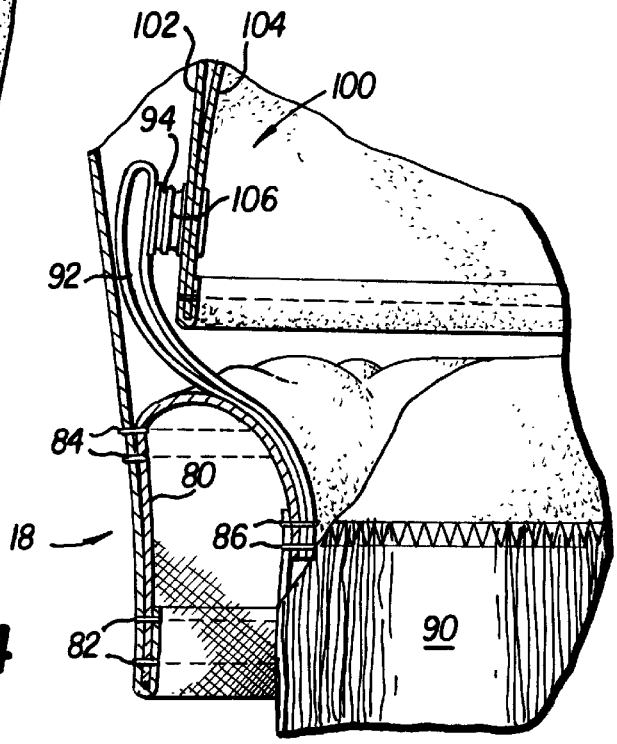
FIG. 4 is an enlarged sectional view of the portion of FIG. 1 indicated by arrows 4—4 showing the lower portion of one of the sleeves of the jacket.

Referring to FIG. 4, one-half of the lower end of sleeve 18 is illustrated, it being understood that the other half of the sleeve is of similar construction. An annular piece 80 of moisture barrier material has one edge thereof stitched at 82 to the lower end of sleeve 18 and also has an intermediate portion thereof stitched at 84 to a portion of the sleeve 18 spaced from the end thereof. The opposite edge of piece 80 is stitched at 86 to the upper end of a conventional wrister 90 which extends out of the lower open end of sleeve 18.

A pair of tabs 92 are connected by stitching 86 to piece 80 and wrister 90 at diametrically opposite sides of wrister 90. Each tab supports a snap fastener 94 in a manner similar to that in which tabs 72 support fasteners 70.

The jacket liner includes a pair of similar sleeve portions. Sleeve portion 100 is disposed within sleeve 18. Sleeve portion 100 includes an outer moisture barrier 102 and inner thermal barrier 104. The upper end of moisture barrier 102 is connected by stitching to moisture barrier 62 in a conventional manner; and the upper end of thermal barrier 104 is connected by stitching to thermal barrier 64 in the usual manner. The lower end of the liner sleeve has a pair of diametrically opposite snap fasteners 106 which engage snap fasteners 94 whereby the lower end of each liner sleeve is detachably connected to piece 80 which is permanently connected to the shell.

As is conventional, the moisture barrier is formed of a plurality of pieces which are stitched together at seams. The moisture barrier has an outer surface facing the shell and an inner surface facing the thermal barrier. Sealing means in the form of sealing tapes are disposed on the inner surface of the moisture barrier in overlapping relationship to the seams so as to extend substantially equally on either side of the seams and throughout the length of the seams. These tapes are well-known in the art and are heat activated so that they may be heat-sealed to the moisture barrier to provide a waterproof seal at the seams.

When it is desired to inspect the seals on seams of the jacket liner, the snap fasteners 66 and 68 are manually disengaged from one another so as to gain access to the space between the moisture barrier and thermal barrier of the liner. The moisture barrier may also be disconnected from the shell by manually disengaging snap fasteners 68 and 70 to facilitate inspection of the seals.

Referring to FIG. 5, moisture barrier 62 has been disconnected from thermal barrier 64 and from shell 14. The liner has also been disconnected from three of fasteners 36. Furthermore, the lower ends of the sleeve portions of the liner have been disconnected from the lower ends of the sleeves of the shell. Thermal barrier 64 has been folded back, and the sleeve portion of the liner has been partially folded inside out as it is pulled out of the associated sleeve. In this position two seams 110 and 112 are visible. These two seams surround the conventional gusset piece disposed at the armpit where a sleeve portion joins the torso portion of the liner. Sealing tapes 114 and 116 overlap seams 110 and 112 respectively and extend along the length of the seams. The sealing tapes are transparent so that the seams and the sealing tapes may be fully visually inspected.

The sleeve of the liner may be completely withdrawn from the sleeve of the shell and turned completely inside out so that all of the seams associated with the sleeve may be visually inspected. The same procedure can be carried out with respect to the other sleeve of the liner. In this manner all of the seams of the jacket may be inspected. After the inspection is complete, the procedure is reversed and the liner can be moved back into its normal operative position.

Figure 6:
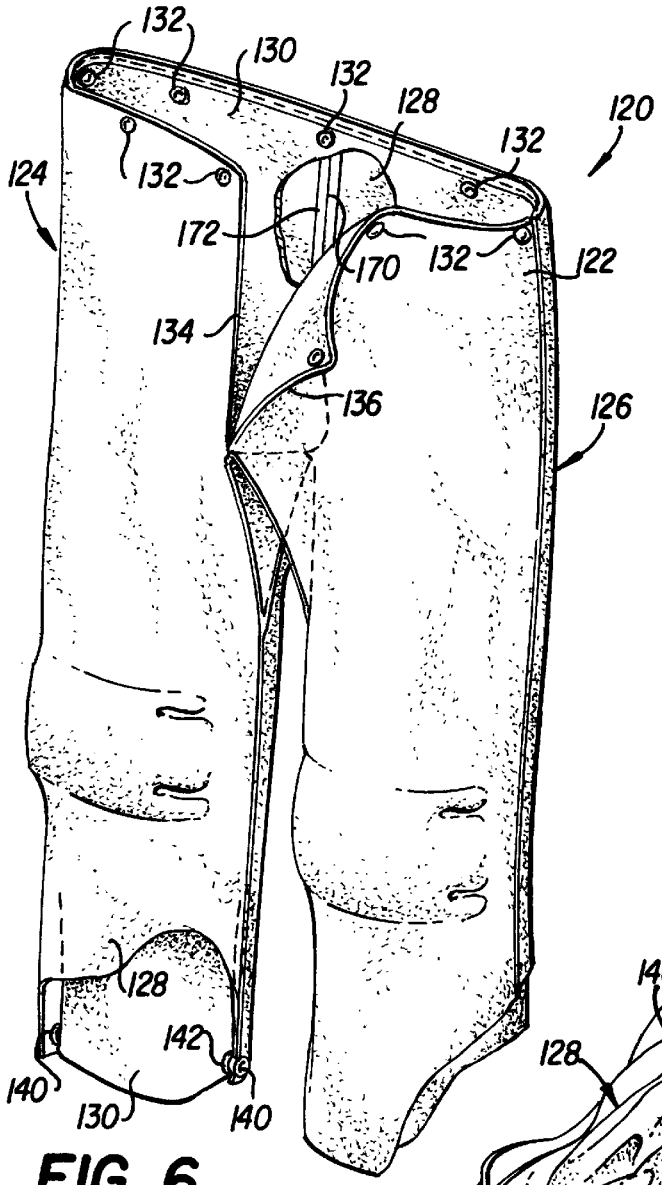
FIG. 6 is a top perspective view partly broken away of the trousers portion of the liner.
Figure 7:
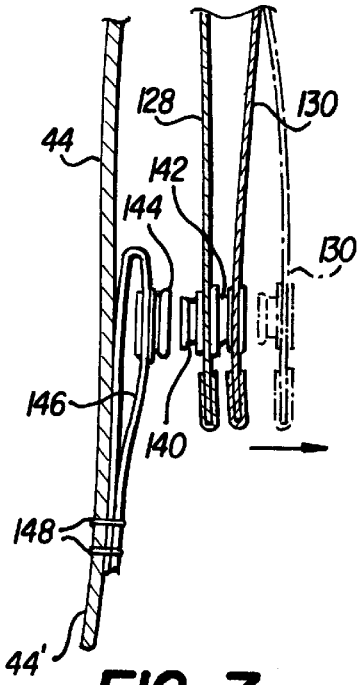
FIG. 7 is an enlarged sectional view of the portion of FIG. 1 indicated by arrows 7—7 showing the means for detachably connecting the moisture barrier and thermal barrier of the trousers portion of the liner as well as the means for detachably connecting the moisture barrier with the outer shell.

Referring to FIGS. 6 and 7, the trousers liner 120 comprises a torso portion 122 and a pair of leg portions 124 and 126 which are adapted to fit within the torso portion 41 and the leg portions 44 and 46 of trousers shell 40 respectively. The torso portion as well as the leg portions of the liner each include an outer moisture barrier 128 and an inner thermal barrier 130. The upper edge portion of liner 120 is provided with a plurality of snap fasteners 132 which are adapted to engage fasteners 54 on the shell 40 for detachably connecting the upper edge portion of the trousers liner to the trousers shell.

Barriers 128 and 130 are permanently connected together by stitching which connects the upper edge portions of the barriers to one another along the top edges thereof and along the fly edges 134 and 136, the rest of barriers 128 and 130 not being permanently connected to one another. Moisture barrier 128 of each leg portion has secured to the lower edge portion thereof a pair of diametrically opposite snap fasteners 140 as seen in FIG. 6. Snap fasteners 140 engage a pair of diametrically opposite snap fasteners 142 (only one of which is visible in FIG. 6) secured to moisture barrier 130. Fasteners 140 also engage fasteners 144 as seen in FIG. 7 which are supported by diametrically opposite tabs 146 similar to tabs 72 which are stitched at 148 to the associated leg portion 44 of the outer shell 40 at a position spaced a short distance from the lower end 44' of the leg portion. These tabs serve to prevent fasteners 70 from heating up. When fasteners 140, 142 and 144 are connected to one another, they prevent the leg portions of the liner from riding up with respect to the leg portions of the shell.

The lower portions of the thermal barrier and the moisture barrier of each leg portion of the liner are detachably connected to one another at two spaced points, and the moisture barrier is detachably connected to the lower end of the associated outer shell leg portion of the trousers at two spaced points.

As is conventional, moisture barrier 128 and thermal barrier 130 are also formed of a plurality of pieces which are stitched together at seams. In a manner similar to that of the aforedescribed jacket, sealing means in the form of sealing tapes are disposed on the inner surface of moisture barrier 128 in overlapping relationship to the seams so as to extend substantially equally on either side of the seams and throughout the length of the seams.

When it is desired to inspect the seals on seams of the trousers liner moisture barrier, snap fasteners 140 and 142 of each leg portion are manually disengaged from one another so as to gain access to the space between the moisture barrier and thermal barrier in each leg portion of the liner. The moisture barrier may also be disconnected from the shell by manually disengaging snap fasteners 140 and 144 and further disengaging snap fasteners 132 and 54 whereupon the trousers liner can be completely removed from the trousers shell to facilitate inspection of the liner seals.

Figure 8:
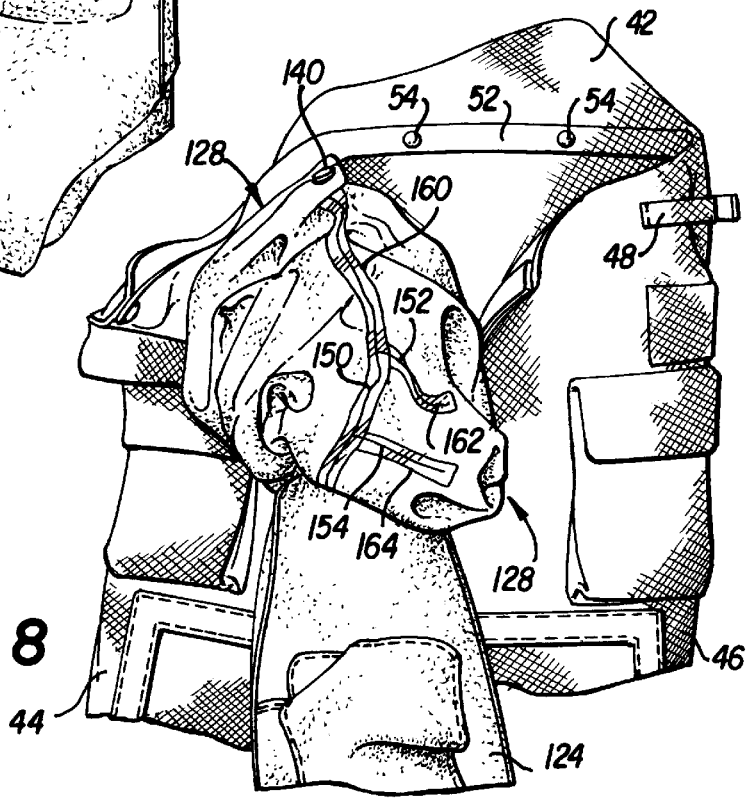
FIG. 8 is a view showing a leg portion of the liner removed from the outer shell and with a portion thereof folded back.

Referring to FIG. 8, moisture barrier 128 has been disconnected from thermal barrier 130 by disconnecting snap fasteners 140 and 142 from one another. The leg portion 124 of the trousers liner has been disconnected from leg portion 44 of the shell by disconnecting snap fasteners 140 and 144. Also, a pair of snap connectors 132 on the liner adjacent fly edge 134 have been disconnected from snap fasteners 54 supported by shell portion 40.

Leg portion 124 of the liner has been withdrawn from leg portion 44 of the shell. Moisture barrier 128 has been partially folded back from the associated thermal barrier leg portion 124. In this position, a seam 150 is intersected by two seams 152 and 154. Sealing tapes 160, 162 and 164 overlap seams 150, 152 and 154 respectively and extend along the length of the seams.

Figure 9:
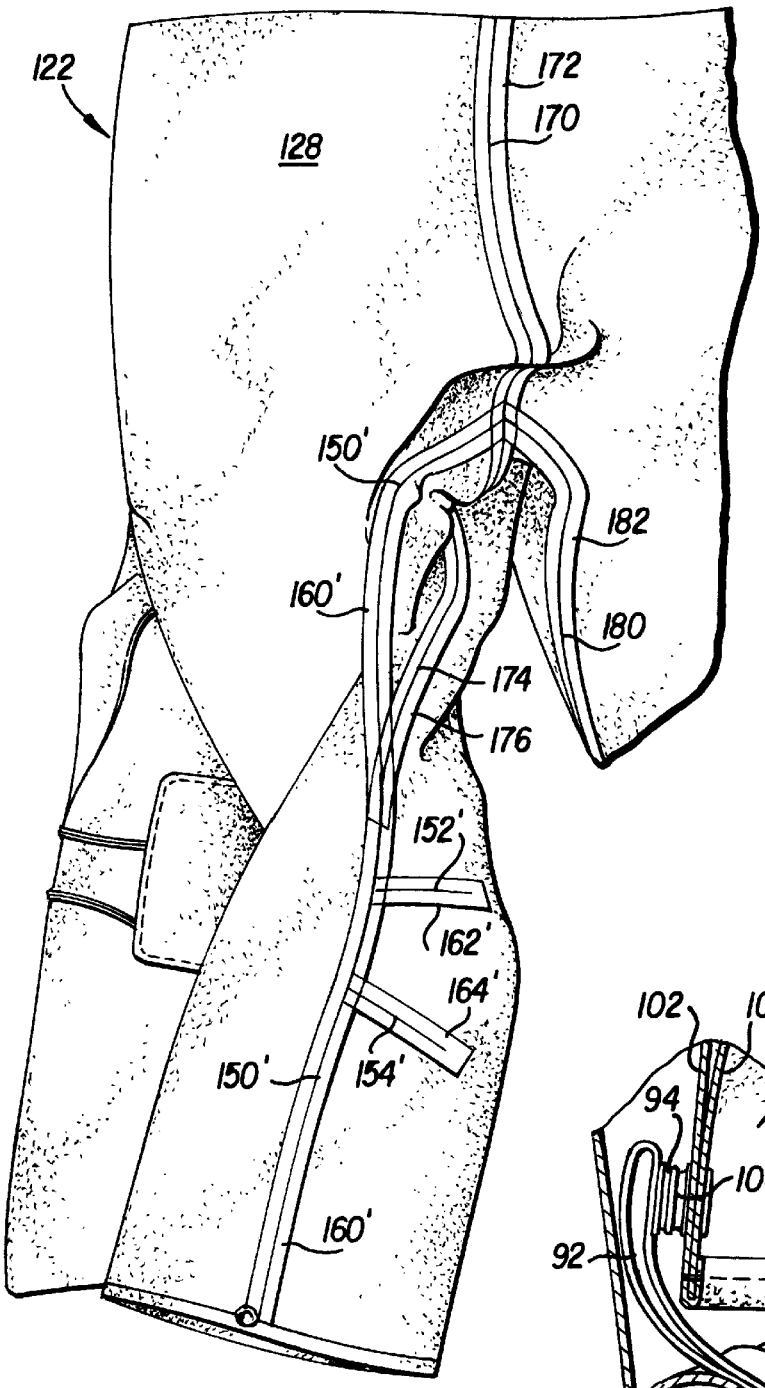
FIG. 9 is a view showing a trousers liner which has been removed from the shell and turned completely inside out.

Referring now to FIG. 9, the trousers liner 120 has been totally removed from the trousers shell and has been completely turned inside out. The Fear part of moisture barrier 128 is shown in elevation with leg portion 126 of the moisture barrier extending downwardly from torso portion 122. A part of the thermal barrier leg portion 130 is seen in elevation behind the moisture barrier leg portion 126.

The seams within leg portion 126 are similar to those within leg portion 124. Therefore, the seams and sealing tapes shown in FIG. 9 which correspond to those shown in FIG. 8 have been given the same reference numeral primed. Seam 150' is the inseam of the moisture barrier leg portion 126, while seams 152' and 154' form tucks at the knee area. The inseam 150' extends from the lower edge of the moisture barrier leg portion 126 upwardly and intersects a back seam 170 which extends upwardly to the waist of the liner. This back seam can also be seen in a broken away portion of FIG. 6. A sealing tape 172 is disposed over seam 170 in the same manner as previously discussed. A further seam 174 extends to the crotch area of the moisture barrier where it intersects the back seam and is sealed by a sealing tape 176. The inseam 180 of the moisture barrier leg portion 124 is sealed by a sealing tape 182.

The two moisture barrier leg portions 124 and 126 can be spread apart to carefully inspect all of the seams in the crotch area. It is noted that all of the seams discussed in connection with the jacket as well as the trousers are conventional in the art and the invention lies in the means to permit visual inspection of the seams throughout the length thereof.

After inspection of the seams in the trousers liner, the liner can again be turned completely inside out whereupon the liner can be inserted into operative position within the trousers shell. The liner can then be detachably connected to the shell adjacent the upper edge of the trousers and the lower ends of the of leg portions of the trousers.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A firefighter garment with liner inspection system comprising, an outer protective shell having a torso portion and a pair of appendage portions connected to said torso portion, a liner disposed within said shell, said liner comprising an outer moisture barrier and an inner thermal barrier, said moisture barrier being formed of a plurality of pieces joined together at seams, said moisture barrier having an outer surface facing said shell and an inner surface facing said thermal barrier, sealing means providing a waterproof seal on said inner surface at said seams, said moisture barrier and said thermal barrier each having a lower edge portion and an upper edge portion, said upper edge portions of said moisture barrier and said thermal barrier being permanently connected to one another, the lower edge portions of said moisture barrier and said thermal barrier being detachably connected to one another at spaced points so that the lower edge portions of the moisture barrier and the thermal barrier can be manually separated from one another to visually inspect said sealing means at all of said seams, said upper edge portions being detachably connected to said shell, and connecting means for detachably connecting spaced points along the lower edge portion of said said moisture barrier to said shell.

2. A garment as defined in claim 1 wherein said sealing means comprises a plurality of sealing tapes overlapping each of said seams and extending along the length of said seams.

3. A garment as defined in claim 1 wherein said connecting means includes a pair of spaced fasteners, a pair of tabs formed of cloth material and being supported by said shell, each tab supporting one of said fasteners in spaced relation to the shell and providing a layer of material between the associated fastener and said shell to prevent overheating of the fastener.

4. A firefighter jacket with liner inspection system comprising, an outer protective shell having a torso portion and a pair of sleeves connected to said torso portion, a liner disposed within said torso portion and said sleeves, said liner comprising an outer moisture barrier and an inner thermal barrier, said moisture barrier being formed of a plurality of pieces joined together at seams, said moisture barrier having an outer surface facing said shell and an inner surface facing said thermal barrier, sealing means providing a waterproof seal on said inner surface at said seams, said moisture barrier and said thermal barrier within said torso portion each having an upper edge portion, a lower edge portion and a pair of side edge portions, said upper edge portions and side edge portions of said moisture barrier and said thermal barrier being permanently connected to one another, said lower edge portions of said moisture barrier and said thermal barrier being detachably connected to one another at spaced points so that the moisture barrier and the thermal barrier can be manually separated from one another to visually inspect said sealing means at all of said seams, means for detachably connecting said moisture barrier and said thermal barrier to said shell along the upper edge portions and side edge portions of said barriers, and connecting means for detachably connecting spaced points along the lower edge portion of said moisture barrier to said shell.

5. A jacket as defined in claim 4 wherein said sealing means comprises a plurality of sealing tapes overlapping each of said seams and extending along the length of said seams.

6. A jacket as defined in claim 4 wherein said connecting means includes a pair of spaced fasteners, a pair of tabs formed of cloth material and being supported by said shell, each tab supporting one of said fasteners in spaced relation to the shell and providing a layer of material between associated fastener and said shell to prevent overheating of the fastener.

7. A jacket as defined in claim 4 wherein said moisture barrier and said thermal barrier define liner sleeves within said shell sleeves, each of said liner sleeves including a lower end detachably connected to said shell.

8. Firefighter trousers with liner inspection system comprising, an outer protective shell having a torso portion and a pair of leg portions connected to said torso portion, a liner disposed within said torso portion and said leg portions, said liner comprising an outer moisture barrier and an inner thermal barrier, said moisture barrier being formed of a plurality of pieces joined together at seams, said moisture barrier having an outer surface facing said shell and an inner surface facing said thermal barrier, sealing means providing a waterproof seal on said inner surface at said seams, said moisture barrier and said thermal barrier each having a torso portion and a pair of leg portions defining an upper edge portion and a lower edge portion, said upper edge portions being permanently connected to one another, said lower edge portions of said moisture barrier and said thermal barrier being detachably connected to one another at spaced points so that the moisture barrier and the thermal barrier can be manually separated from one another to visually inspect said sealing means at all of said seams, means for detachably connecting said moisture barrier and said thermal barrier to said shell along the upper edge portions thereof, and connecting means for detachably connecting spaced points along the lower edge portions of said moisture barrier to said shell.

9. Trousers as defined in claim 8 wherein said sealing means comprises a plurality of sealing tapes overlapping each of said seams and extending along the length of said seams.

10. Trousers as defined in claim 8 wherein said connecting means includes a pair of spaced fasteners, a pair of tabs formed of cloth material and being supported by said shell, each tab supporting one of said fasteners in spaced relation to the shell and providing a layer of material between associated fastener and said shell to prevent overheating of the fastener.

* * * * *